US005165147A

United States Patent [19]

Kuo

[11] Patent Number: 5,165,147

[45] Date of Patent: Nov. 24, 1992

[54] STATIONARY CLASP

[76] Inventor: Hua-Chou Kuo, No. 15, Alley 10, Lane 118 Szu Wei Rd., Wu Ku Taipei, Taiwan

[21] Appl. No.: 721,874

[22] Filed: Jun. 26, 1991

[51] Int. Cl.[5] ..... A44B 21/00

[52] U.S. Cl. ..... 24/346; 24/511

[58] Field of Search ..... 24/511, 508, 507, 501, 24/500, 327, 334, 343, 346; 223/91, 93, 96

[56] References Cited

U.S. PATENT DOCUMENTS

| | | | |
|---|---|---|---|
| 104,654 | 1/1870 | Searles | 24/511 |
| 253,414 | 2/1882 | Neal | 24/346 |
| 541,384 | 6/1895 | Pascoe | 24/346 X |
| 1,149,444 | 8/1915 | Hodgson | 24/511 X |
| 2,261,089 | 10/1941 | Kurtz | 24/511 X |
| 4,701,983 | 10/1987 | Warmath | 24/511 |

FOREIGN PATENT DOCUMENTS

| | | | |
|---|---|---|---|
| 158301 | 2/1921 | United Kingdom | 24/511 |
| 660083 | 2/1952 | United Kingdom | 24/511 |

*Primary Examiner*—James R. Brittain

*Attorney, Agent, or Firm*—Larson & Taylor

[57] ABSTRACT

A clasp is disclosed which includes two mating elongate jaw members that are pivotally connected together about a pivot axis such that the jaws of the members are longitudinally spaced from, but in abutting relationship with, each other. Each jaw member has a longitudinal recess in its inner surface, and is also provided with an inwardly depressed rib that defines a slot between the rib and the inner surface of the member and which mounts the front end of an arcuate elastic member such that the arcuate sections of the members bow outwardly and resiliently engage their respective jaw member in the recess.

15 Claims, 4 Drawing Sheets

STATIONARY CLASP

FIELD OF THE INVENTION

The invention is related to a creatively-designed stationary folder or clasp equipped with two arc-shaped elastic pieces between two jaw members.

DESCRIPTION OF THE PRIOR ART

Conventional stationary clasps' design are all equipped with a fixed axis and a spiral spring on the axis (as shown in FIG. 1). Thus, by means of the elasticity of the spiral spring, the two folds or jaw members are able to hold objects such as documents and clothes. This device has been used for quite a long time and so far no creative alternative design has been able to take its place. The mass consumers during this long period have become used to this product, in spite of its defects. However, obviously this device has its flaws both in manufacture and use. In other words, this product should be replaced with a better design so as to benefit both the manufacturers and consumers. This product has three common defects:

1. The cost of producing spiral springs is relatively high, is not easily produced in bulk and is hard to install.
2. The fold mouth or jaw is designed in a flat and straight shape and the connection between the two jaws, or bite, is lineal thus failing to hold thinner objects effectively.
3. Because that is no hook, this design is relatively inconvenient to hang.

The above-mentioned defects are common and obvious shortcomings of regular stationary clasps and clothes hangers, and these flaws still have room to be improved.

SUMMARY OF THE INVENTION

This invention involves a newly-designed stationary folder or clasp. The design mainly takes advantage of two arc-shaped or arcuate elastic pieces installed between two folds or jaw members as the source of force to hold objects between the jaw members. The grasping ends formed by the front ends of the two folds is a surface or plane contact which increases the holding effect, particularly for thin objects, compared with conventional clasps which are confined to a linear contact between the engaging edges of the jaw members. In this plane contact jaw, the hold part of the two jaw members is not on the same line, but one jaw member is located in the front, while the other is in the back with the front end of the back jaw member's jaw touching the back edge of the other jaw member's jaw. The top jaw member also has a downwardly projected edge which combines with the back fold's jaw member's jaw so as to form a zigzag. With this effect of increasing the contact area, even relatively thin objects can be held without a hitch.

One end of each elastic piece is squeezed in between the inside of the jaw members, while the other ends are interconnected so that the jaw members have a greater grip by virtue of the elasticity produced from the two elastic pieces. Moreover, one of the elastic pieces has a hook formed at one end so that it will be much more convenient to hold objects without a need to take advantage of the space between the jaw members grasping ends and ear stands. This makes the stationary clasp more convenient when being hung for display and avoids the regular way of being hung by the opening between the fold jaw and the pivot boss or ear stand. This is very important for using stationary folders to hang things, because conventional stationary clasps have to be hung with threads or on other hangers which is very inconvenient.

In view of the aforementioned defects in the prior art, with a research spirit that second best is not good enough, the inventor of the present invention, through incessantly strenuous effort in experimentation and development, ultimately developed the present invention, a stationary clasp that is mainly aimed at the ease of installation and lower manufacturing cost.

A secondary purpose of this invention is to offer a planar or surface contact clasp jaw which can improve the holding effect of thinner objects.

Another purpose of this invention is to offer a stationary clasp which can be easily hung.

BRIEF DESCRIPTION OF THE DRAWINGS

The following part is to explain this invention's structure and features in conjunction with diagrams.

DETAILED DESCRIPTION OF THE PREFERRED EMBODIMENT

Figure 1:
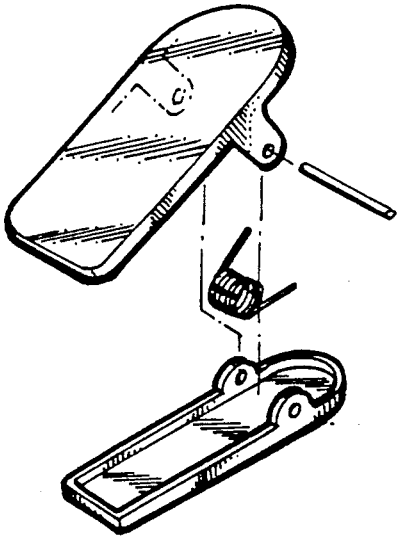
FIG. 1 is a three-dimensional perspective view of a conventional stationary clasp.
Figure 2:
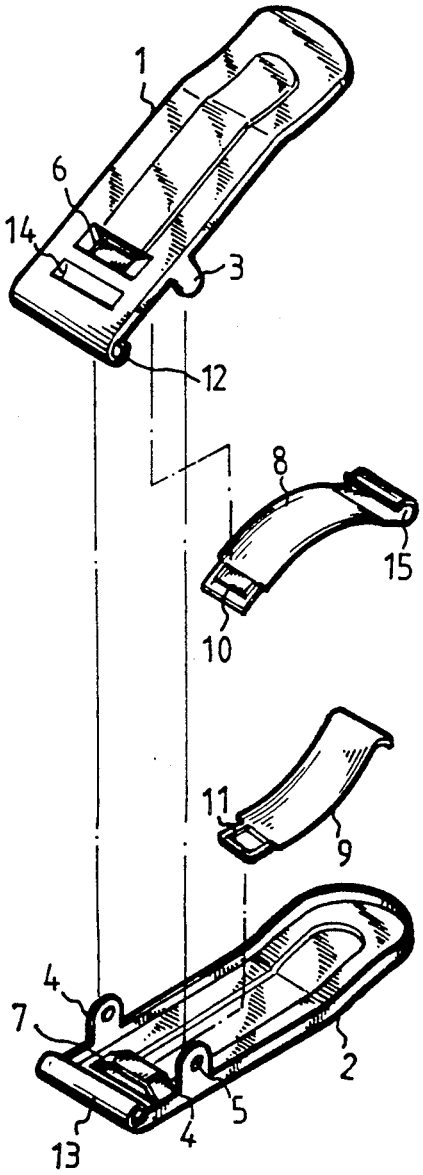
FIG. 2 is a three-dimensional exploded perspective view of the present invention.

As depicted in FIG. 2, an upper fold piece or jaw member 1 and lower fold piece or jaw member 2 include an ear stand or pivot boss 3 and ear stand or pivot boss 4. In addition, lower jaw member 2's pivot boss 4 has a thorough hole 5 by which jaw members 1 and 2 can be pivotably connected. Pivot bosses 3 and 4 can be squeezed and combined together. That is, upper jaw member 1's pivot boss 3 can be pressed into pivot boss 4's hole 5 of lower jaw member 2 with a protruding or projected edge or with an axle to connect the holes 5 of pivot bosses 3 and 4.

Figure 3:
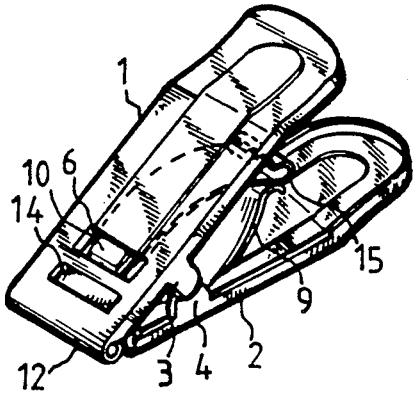
FIG. 3 is a three-dimensional perspective view of an assembled configuration of the present invention.
Figure 4:
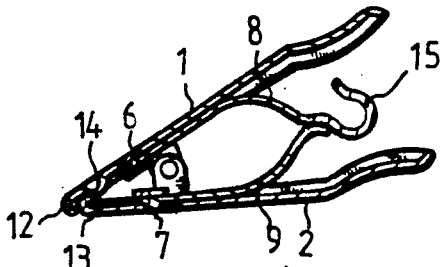
FIG. 4 is a side cross-sectional view of the present invention.

Each jaw member 1 and 2 has an elastic piece fixing stand or rib members 6 and 7, respectively located at jaw members 1 and 2 adjacent the front of pivot bosses 3 and 4. Between elastic piece flanges 6 and 7 and the surface of the inside edge of jaw members 1 and 2, there is a small hiatus or slot 1 in which the front ends of two elastic arcuate pieces or members 8 and 9 can be inserted and thus fixedly engaged. At the front ends of elastic members 8 and 9, there are raised portions 10 and 11 which can be squeezed into rib members 6 and 7 which fix or secure elastic members 8 and 9. Thus the ends of elastic members 8 and 9 are in the form of relative contact, see FIG. 3 and FIG. 4. As a result of the elastic holding strength of elastic members 8 and 9, jaw members 1 and 2 are able to hold documents or other objects.

The mouth or jaw design of jaw members 1 and 2 according to this invention is a planar type of contact. Namely, upper jaw member 1's mouth or jaw 12 is located a little bit ahead of lower jaw member 2's mouth or jaw 13. The front edge of lower jaw member 2's jaw 13 is exactly squeezed into the back edge of upper jaw member 1's jaw 12. When jaw members are pressed down or engaged, at the place a little behind of upper jaw member 1's jaw 12 there is a projected or depressed edge or portion 14 which is exactly squeezed into or mated with the back edge of lower jaw member 2's jaw 13. Hence, lower jaw member 2's jaw 13 and upper jaw member 1's jaw 12 contact each other in a plane by which the clasp's capacity to hold thinner objects is greatly increased.

At the end of elastic member 8, there is a bent part, or hanger loop 15. With hanger loop 15, the clasp can be hung on a rope or a hanger rack.

Figure 5:
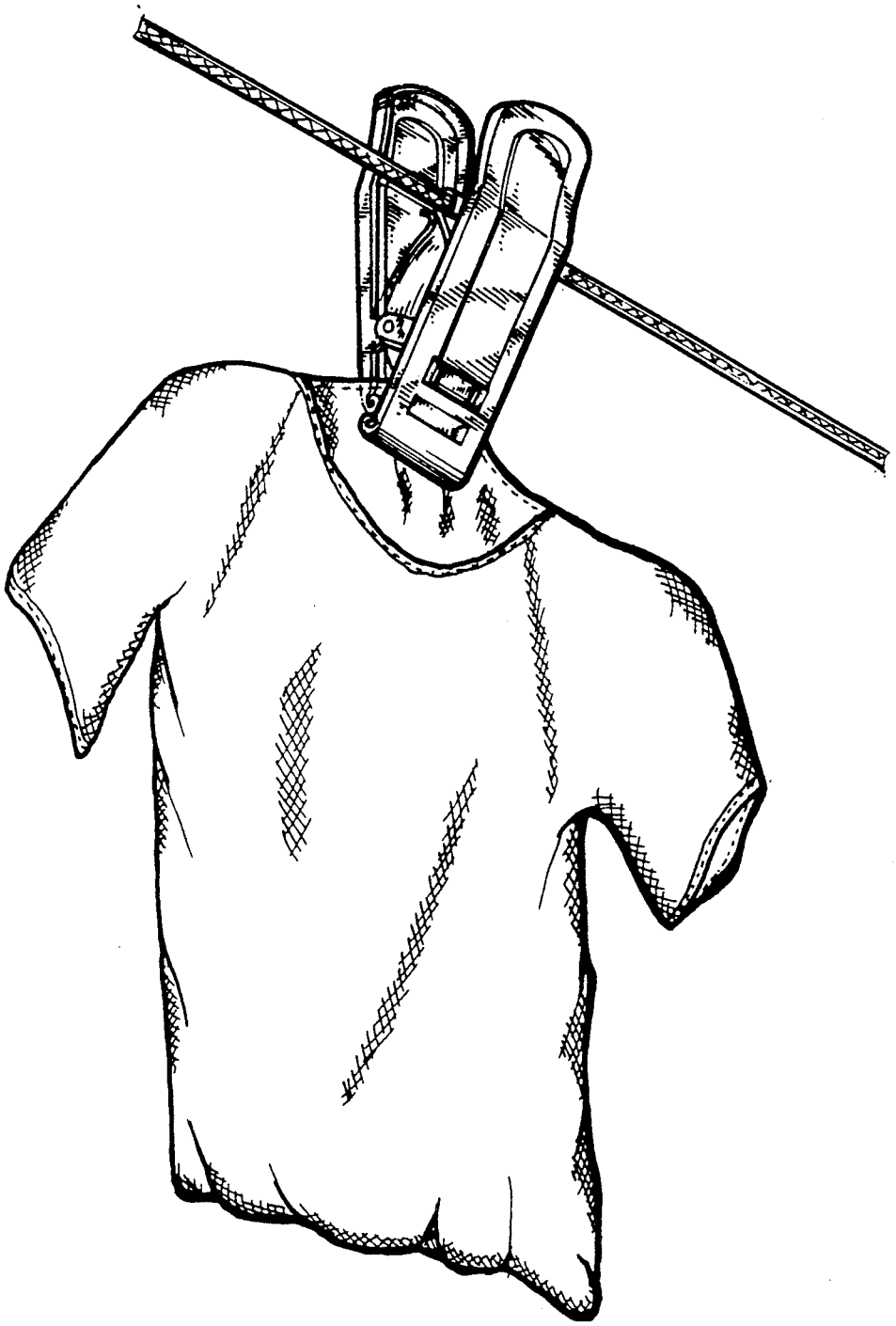
FIG. 5 depicts an applied example of the present invention.

Practical examples of the application of the invention, such as hanging clothes on a rope, can be seen in FIG. 5. This demonstrates that this invention is evidently much more practical than conventional or regular clasps.

In summary, this invention not only has a simple structure but also has a reduced manufacturing cost. Moreover, it has a greater ability for holding thinner objects and for stationary hanging of objects for exhibition. Therefore, this invention is indeed practical and useful.

I claim:

1. A stationary clasp comprised of a first and second jaw member having opposed inner faces, outer faces on the other sides of each inner face, a rear end, and a clasping forward end, each said first and second jaw member having a corresponding first and second flange mounted to said inner face thereof so as to provide a slot between said inner face and the opposing side of said flange:

means for pivotally mounting said first and second jaw members together at a location that is closer to said forward end than to said rear end such that said first jaw member inner face opposes said second jaw member inner face;

a first arcuate elastic member mounted in said slot between said first flange and said first jaw member inner face; and a second arcuate elastic member mounted in said slot between said second flange and said second jaw member inner face, wherein one of said elastic members is comprised of a bent hook member located at one end thereof;

whereby said elastic members are squeezed in between said jaw members to provide the force needed to hold objects between said jaw members.

2. A stationary clasp as claimed in claim 1 wherein said first and second jaw members each further includes a transverse portion at said forward end and said first jaw member forward end is located in front of said second jaw member, and an inwardly and transversely extending boss located on said first jaw member.

3. A stationary clasp as claimed in claim 1 wherein said first and second mounting flanges are each comprised of a transverse strip of the corresponding one of said first and second jaw members, each strip being indented toward the other of said jaw members so as to provide said slot.

4. A clasp comprising a first and a second jaw member each having a front end, a rear end, an outer surface and an inner surface;

means for pivotally mounting said first and second jaw members together at a location that is closer to said front end than to said rear end such that said first jaw member inner surface opposes said second jaw member inner surface;

a first and a second arcuate elastic member each having a front end portion, a middle arcuate section, and a rear end portion which correspond to said jaw members front ends and rear ends;

first mounting means at said first jaw member inner surface between said pivotally mounting means and said front end thereof for mounting said first elastic member front end portion and;

second mounting means at said second jaw member inner surface between said pivotally mounting means and said front end thereof for mounting said second elastic member front end portion; and wherein said elastic members are mounted such that their respective arcuate sections contacts the corresponding inner surface of said jaw members between said pivotally mounting means and said rear ends thereof so as to resiliently engage said jaw member front ends with each other.

5. The clasp as claimed in claim 4 wherein each said first and second jaw members is elongate and is comprised of a first forward portion that is substantially planar and an integral second, rearward portion that is curved inwardly toward the other jaw member.

6. The clasp as claimed in claim 5 wherein said front end of said first jaw member is rounded in elevational view and wherein said front end of said second jaw member is rounded in elevational view, but is located behind said first jaw member front end in an engaging relationship therewith.

7. The clasp as claimed in claim 6 wherein said front end of said first jaw member further comprises an inwardly and transversely extending boss located on said first jaw member rearwardly of said rounded front end so as to be engageable with the rearward side of said second jaw member rounded front end.

8. The clasp as claimed in claim 5 wherein said first and second jaw member forward portion includes an elongated recess in said inner surface thereof having dimensions such that said elastic member can be received therein when the rearward portions of said jaw members are pushed together.

9. The clasp as claimed in claim 5 wherein said first and second mounting means each comprises a rib member that is comprised of a transverse strip of the corresponding one of said first and second jaw members, each strip being indented toward the other of said jaw members so as to provide a slot between said inner surface and the opposing side of said strip; and and wherein said corresponding first or second elastic member front end portion is removable received in said slot.

10. The clasp as claimed in claim 9 wherein said first and second elastic member front end portions each further includes a raised portion which can engage the forward side of said strip when said elastic member front end is inserted into said slot, and thereby retain said elastic member in said slot.

11. The clasp as claimed in claim 9 wherein said first and second elastic member have an arcuate shape and dimensions such that the rear end portions thereof engage one another when said elastic members are mounted in the corresponding mounting means.

12. The clasp as claimed in claim 4 wherein said first and second mounting means each comprises a rib member that is comprised of a transverse strip of the corresponding one of said first and second jaw member, each strip being indented toward the other of said jaw members so as to provide a slot between said inner surface and the opposing side of said strip; and and wherein said corresponding first or second elastic member front end portion is removably received in said slot.

13. The clasp as claimed in claim 12 wherein said first and second elastic member front end portions each further includes a raised portion which can engage the forward side of said strip when said elastic member front end is inserted into said slot, and thereby retain said elastic member in said slot.

14. The clasp as claimed in claim 12 wherein said first and second elastic member have an arcuate shape and dimensions such that the rear end portions thereof engage one another when said elastic members are mounted in the corresponding mounting means.

15. The clasp as claimed in claim 4 wherein said first and second jaw member front end includes an elongated recess in said inner surface thereof having dimensions such that said elastic member can be received therein when the rearward ends of said jaw members are pushed together.

* * * * *

UNITED STATES PATENT AND TRADEMARK OFFICE

CERTIFICATE OF CORRECTION

PATENT NO. : 5,165,147

DATED : November 24, 1992

INVENTOR(S) : Kuo Hua CHOU

It is certified that error appears in the above-identified patent and that said Letters Patent is hereby corrected as shown below:

On the title page, item [75] inventor: Kuo Hua CHOU

Signed and Sealed this

Fifth Day of October, 1993

*Attest:*

*Attesting Officer*

BRUCE LEHMAN

*Commissioner of Patents and Trademarks*